US006815507B2

(12) United States Patent
Ohama

(10) Patent No.: US 6,815,507 B2
(45) Date of Patent: Nov. 9, 2004

(54) GOLF BALL WITH IMPROVED SHOT FEEL WITHOUT DETERIORATION IN DURABILITY AND FLIGHT PERFORMANCE

(75) Inventor: Keiji Ohama, Kobe (JP)

(73) Assignee: Sumitomo Rubber Industries, Ltd., Kobe (JP)

( * ) Notice: Subject to any disclaimer, the term of this patent is extended or adjusted under 35 U.S.C. 154(b) by 0 days.

(21) Appl. No.: 10/157,865

(22) Filed: May 31, 2002

(65) Prior Publication Data

US 2003/0073784 A1 Apr. 17, 2003

(30) Foreign Application Priority Data

Jun. 1, 2001 (JP) ..... 2001-166764

(51) Int. Cl.[7] ..... A63B 37/06; C08L 9/00

(52) U.S. Cl. ..... 525/261; 525/274; 525/332.6; 473/371; 473/372; 473/377

(58) Field of Search ..... 525/261, 274, 525/332.6; 473/371, 372, 377

(56) References Cited

U.S. PATENT DOCUMENTS 5,252,652 A 10/1993 Egashira et al.
5,645,496 A 7/1997 Endo et al.
5,861,465 A * 1/1999 Hamada et al. ..... 525/332.6
6,465,578 B1 * 10/2002 Bissonnette et al. ..... 525/261
6,565,453 B2 * 5/2003 Maruoka ..... 473/357

FOREIGN PATENT DOCUMENTS

AU 09923581 * 10/1999
JP 60-249979 A 12/1985
JP 11-290479 A 10/1999

OTHER PUBLICATIONS

Thain, Science and Golf IV, Jul. 2002, pp. 319–327.*

* cited by examiner

*Primary Examiner*—David J. Buttner
(74) *Attorney, Agent, or Firm*—Birch, Stewart, Kolasch & Birch, LLP

(57) ABSTRACT

A golf ball having an improved shot feel without deterioration in durability and flight performance is provided. The golf ball is constituted of at least two layers including a core and a cover. The core is formed of a rubber composition including 100 parts by weight of a rubber component, 0.01 to 0.5 parts by weight of sulfur and 0.05 to 5 parts by weight of an organic sulfur compound. An amount of deformation of the core under a load from an initial load of 98 N to a final load of 1274 N is 2.5 to 6.0 mm. A difference determined by subtracting a center hardness of the core from a surface hardness of the core is at least 25 in terms of JIS-C hardness.

10 Claims, No Drawings

GOLF BALL WITH IMPROVED SHOT FEEL WITHOUT DETERIORATION IN DURABILITY AND FLIGHT PERFORMANCE

BACKGROUND OF THE INVENTION

1. Field of the Invention

The present invention relates to golf balls. In particular, the present invention relates to a golf ball providing an improved shot feel without deterioration in the durability and flight performance.

2. Description of the Background Art

Golf balls generally on the market include solid golf balls and thread-wound golf balls. A solid golf ball is constructed of a solid core and a cover formed over the solid core. The solid core is formed by vulcanizing and molding a rubber composition containing polybutadiene as a main component. A thread-wound golf ball is constructed of a thread-wound core and a cover formed over the core. The thread-wound core is formed by winding a rubber thread around a rubber-based or liquid-based center.

The cover of the solid golf ball is made of hard resin, and thus the solid golf ball is superior in durability and carry (distance) while the solid golf ball is inferior in shot feel. On the other hand, the thread-wound golf ball is excellent in shot feel and controllability while the durability and carry thereof are unsatisfactory.

In recent years, solid golf balls have come to dominate the market since recent solid golf balls provide a soft feel similar to that of conventional thread-wound golf balls with a longer carry or distance retained. Nevertheless, the solid golf balls should still be improved in terms of compromise between the shot feel and the durability and carry.

Two-piece golf balls have been preferred by professional golfers because of the long carry thereof. However, one drawback of the long-carry two-piece golf balls is a poor shot feel. Multi-piece golf balls such as three-piece golf balls are inferior in carry while providing an excellent shot feel since a multi-piece golf ball has a wide range of hardness distribution as compared with a two-piece golf ball.

It is known, as a method of providing a softer shot feel of the golf balls as described above, to soften a core of a golf ball, for example, by increasing a difference between a surface hardness and a center hardness of the core. However, one problem of this method is that the durability of the golf ball tends to deteriorate and the softened core results in a shorter carry.

Various techniques for overcoming the problem above have been disclosed. For example, Japanese Patent Laying-Open No. 60-249979 discloses a golf ball including a core made of a rubber composition containing, per 100 parts by weight of polybutadiene, 25–40 parts by weight of zinc acrylate (calculated as the weight of acrylic acid) and 0.05–0.6 parts by weight of sulfur. This golf ball without organic sulfur compound has a poor rebound property. Moreover, the difference between the surface hardness and the center hardness of the core is not optimized which results in inferior flight performance and shot feel.

U.S. Pat. No. 5,252,652 discloses a multi-layered solid golf ball constituted of a core and a cover, including a base rubber component to which added an unsaturated carboxylic acid metal salt, a zinc salt of any thiophenol, and a crosslinking agent, and having an outer diameter of 37.5–39.5 mm, and its deflection under a load of 100 kg is 3–4.5 mm. This golf ball without sulfur is inferior in durability as well as flight performance and shot feel because the difference between the surface hardness and the center hardness is not optimized.

U.S. Pat. No. 5,645,496 discloses a two-piece golf ball constituted of a core and a cover. The core includes 100 parts by weight of a base rubber to which a co-crosslinking agent and an organic peroxide are added. The center hardness of the core is 40–57 and the surface hardness thereof is 70–95 in terms of JIS-C hardness. The amount of deformation generated between an initial loading of 10 kg and a final loading of 130 kg is 3.0–4.8 mm. Although there is a great difference between the surface hardness and the center hardness of the core of the golf ball, absence of sulfur results in poor durability. Moreover, no organic sulfur compound is added to in the core and accordingly the rebound property is unsatisfactory.

Japanese Patent Laying-Open No. 11-290479 discloses a two-piece solid golf ball constituted of a core and a cover. The center hardness and the surface hardness of the core are respectively 60 or less and 70–95 in terms of JIS-C hardness, and the difference between the center hardness and the surface hardness of the core is 20–40. The amount of deformation of the core under a load from an initial load of 10 kg to a final load of 130 kg is 2.6–3.5 mm. Shore D hardness of the cover is 60 or less and the thickness of the cover is 1.2–2.0 mm. Although the difference between the surface hardness and the center hardness of the core is large, no sulfur is added to the golf ball which accordingly has an inferior durability.

SUMMARY OF THE INVENTION

One object of the present invention is thus to provide a golf ball having an improved shot feel without deterioration in the durability and flight performance.

According to one aspect of the present invention, a golf ball is constituted of at least two layers including a core and a cover. The core is formed of a rubber composition including 100 parts by weight of a rubber component, 0.01 to 0.5 parts by weight of sulfur and 0.05 to 5 parts by weight of an organic sulfur compound.

Preferably, an amount of deformation of the core under a load from an initial load of 98 N to a final load of 1274 N is 2.5 to 6.0 mm.

Preferably, a difference determined by subtracting a center hardness of the core from a surface hardness of the core is at least 25 in terms of JIS-C hardness.

Preferably, the core has a center hardness less than 55 in terms of JIS-C hardness.

DESCRIPTION OF THE PREFERRED EMBODIMENTS

A softer shot feel of a golf ball is achieved by an increased difference between the center hardness and the surface hardness of a core of the ball. Moreover, the increased difference between the center hardness and the surface hardness of the core increases deformation at a shot. A resultant greater launch angle together with a resultant lower spin rate enhance flight performance. However, such an increase of the core deformation degrades the rebound property and durability of the golf ball.

An organic sulfur compound is added to a rubber composition of a core to enhance the rebound property and durability of a golf ball. In this case, however, the difference between the center hardness and the surface hardness of the core decreases which adversely affects the shot feel and flight performance of the golf ball.

The inventor of the present invention has attained the invention according to a new finding that sulfur together with the organic sulfur compound may be added to a core to decrease the center hardness of the core and thus increase the difference between the center hardness and the surface hardness of the core, and accordingly improve the shot feel and flight performance, keep a proper rebound property and enhance the durability of the golf ball.

A golf ball according to the present invention is constituted of at least two layers including a core and a cover. The core is formed of a rubber composition including 100 parts by weight of a rubber component, 0.01 to 0.5 parts by weight of sulfur and 0.05 to 5 parts by weight of an organic sulfur compound.

The content of the sulfur in the core is 0.01 to 0.5 parts by weight, preferably 0.01 to 0.3 parts by weight, and more preferably 0.01 to 0.1 parts by weight, based on 100 parts by weight of the rubber component. This is because the sulfur content lower than 0.01 parts by weight makes it difficult to secure an appropriate difference between the center hardness and the surface hardness of the core, and such a content less than 0.01 parts by weight deteriorates durability. On the other hand, the sulfur content higher than 0.5 parts by weight causes delay in vulcanization with the sulfur. Consequently, optimum hardnesses are impossible to achieve and the rebound property is degraded.

The organic sulfur compound may be thiophenol, thiocarboxylic acid, sulfide compounds, and metal salts thereof, for example. A particularly preferred organic sulfur compound is any of disulfide compounds.

The content of the organic sulfur compound in the core is 0.05 to 5 parts by weight, preferably 0.1 to 2 parts by weight, and more preferably 0.2 to 1.5 parts by weight, based on 100 parts by weight of the rubber component. This is because the organic sulfur compound content lower than 0.05 parts by weight results in deterioration in the rebound property of the golf ball. On the other hand, the organic sulfur compound content higher than 5 parts by weight makes it difficult to secure an appropriate difference between the center hardness and the surface hardness of the core, and such a content higher than 5 parts by weight degrades the rebound property and flight performance.

Here, respective amounts of the organic sulfur compound and sulfur added to the rubber component in the rubber composition of the core are represented respectively by A and B in terms of parts by weight. Then, the ratio of B (sulfur) to A (organic sulfur compound), i.e., B/A is suitably 0.01 to 2.0, preferably 0.05 to 1.0, and more preferably 0.1 to 0.5. If the ratio B/A is smaller than 0.01, the content of the sulfur is insufficient to improve the durability. On the other hand, if the ratio B/A is greater than 2.0, the content of the organic sulfur compound is insufficient to improve the rebound property.

According to the present invention, an appropriate rubber component in the rubber composition of the core of the golf ball is polybutadiene. Alternatively, another rubber such as isoprene rubber, natural rubber or styrene butadiene rubber may also be blended in the rubber composition.

A crosslinking agent to be added to the rubber composition is unsaturated carboxylic acid or metal salt thereof. For the golf ball of the present invention, zinc methacrylate and zinc acrylate are particularly preferable crosslinking agents. Per 100 parts by weight of the rubber component, 10 to 50 parts by weight, preferably 10 to 45 parts by weight, and more preferably 15 to 45 parts by weight of the crosslinking agent are added to the rubber composition. The content of the crosslinking agent lower than 10 parts by weight results in an excessively low crosslinking density in the core and accordingly the core becomes too soft. In addition, the rebound property and durability are deteriorated. On the other hand, if the content of the crosslinking agent is higher than 50 parts by weight, the crosslinking density is too high which makes the core excessively hard and accordingly deteriorates shot feel.

A vulcanization initiator to be added to the rubber composition is any organic peroxide such as dicumyl peroxide. 0.1 to 3 parts by weight of the organic peroxide, preferably 0.3 to 3 parts by weight, and more preferably 0.5 to 2.5 parts by weight of the organic peroxide are added to the rubber composition.

The rubber composition is vulcanized at 140 to 180° C. for 10 to 60 minutes. A higher vulcanization temperature is desirable for the purpose of increasing the difference between the center hardness and the surface hardness of the core. For example, if the dicumyl peroxide is used as a vulcanization initiator, the vulcanization temperature is suitably at least 160° C.

The rubber composition may be blended with an inorganic filler such as a metallic oxide or a metal of high specific gravity for the purpose of adjusting the specific gravity of the core.

The amount of deformation of the core after vulcanization and under a load from an initial load of 98 N to a final load of 1274 N is 2.5 to 6.0 mm, preferably 2.7 to 5.5 mm, and more preferably 3 to 5 mm. If the amount of deformation of the core is smaller than 2.5 mm, the core itself is too hard resulting in a poor shot feel regardless of the difference between the center hardness and the surface hardness of the core. On the other hand, if the amount of deformation of the core is greater than 6.0 mm, the core is too soft resulting in deterioration in the rebound property and durability.

Regarding the hardnesses of the core, the difference determined by subtracting the center hardness of the core from the surface hardness thereof is at least 25, preferably 25 to 50, more preferably 27 to 50, and particularly preferably 30 to 50 in terms of JIS-C hardness. If the difference between the surface hardness and the center hardness of the core that is determined as described above is smaller than 25, the amount of deformation is small and accordingly the shot feel and flight performance are degraded. It is difficult to secure a core hardness difference which is greater than 50.

The center hardness of the core is less than 55, preferably 35 to 53, and more preferably 40 to 50 in terms of JIS-C hardness. This is because the core having a center hardness greater than 55 is felt hard at shot to provide a poor shot feel.

The surface hardness of the core is 60 to 90 and preferably 65 to 90 in terms of JIS-C hardness. A surface hardness of the core that is smaller than 60 makes the core excessively soft to deteriorate the rebound property and durability. On the other hand, a surface hardness of the core that is greater than 90 deteriorates the shot feel regardless of the difference between the center and surface hardnesses of the core.

According to the present invention, the cover of the golf ball is not limited to a specific one. Various conventional covers are applicable to the cover of the present invention. The cover generally includes, as a base resin, a resin composition constituted of a blend of one or at least two of thermoplastic resin (particularly ionomer resin), polyester, polyurethane, polyolefin, and polystyrene-based thermoplastic resin. Alternatively, the resin of the cover may mainly be composed of trans-1,4-polyisoprene. The resin of the cover contains appropriate amounts of an inorganic filler(s)

and a pigment(s) for example. One example of the ionomer resin is a binary copolymer, for example, of α-olefin and α, β-unsaturated carboxylic acid with 3 to 8 carbons, and at least a part of a carboxyl group thereof is neutralized by metallic ion. Another example of the ionomer resin as a base resin material for the cover is a ternary copolymer of α-olefin, α, β-unsaturated carboxylic acid with 3 to 8 carbons, and α, β-unsaturated carboxylic acid ester with 2 to 22 carbons, and at least a part of a carboxyl group thereof is neutralized by metallic ion. The α-olefin mentioned above includes ethylene, propylene, 1-butene, 1-pentene and the like, for example, and particularly ethylene is preferred. The α, β-unsaturated carboxylic acid with 3 to 8 carbons includes acrylic acid, methacrylic acid, fumaric acid, maleic acid, crotonic acid and the like, for example, and particularly acrylic acid and methacrylic acid are preferred. The unsaturated carboxylic acid ester includes methyl, ethyl, propyl, n-butyl and isobutyl ester of acrylic acid, methacrylic acid, fumaric acid, and maleic acid, for example, and particularly acrylate and methacrylate are preferred.

The JIS-C hardness of the cover is not particularly limited to a specific value. The JIS-C hardness is preferably 95 or less and more particularly 80 to 93. The JIS-C hardness of 95 or less, together with a large difference between the center hardness and the surface hardness of the core, facilitates improvements of the shot feel and flight performance.

The diameter of the core is preferably 20 to 41.5 mm and more preferably 25 to 40 mm. If the core diameter is smaller than 20 mm, this small core does not effectively function as a core. On the other hand, if the core diameter exceeds 41.5 mm, the rebound property and durability are degraded.

The core is covered with at least one cover layer. The total thickness of the cover layer composed of one layer or at least two layers is preferably 0.5 to 11 mm and more preferably 0.8 to 9 mm. The total thickness of the cover layer smaller than 0.5 mm does not appropriately serve to improve the rebound property and durability for example. On the other hand, if the total thickness of the cover layer exceeds 11 mm, the thick cover hinders the core from functioning effectively as a core.

Only an outer cover made of a resin composition may be formed over the core. Alternatively, the core may be covered with an inner cover made of a rubber composition and/or resin composition and an outer cover made of a resin composition. Moreover, three or more cover layers may be formed over the core. Thus, the golf ball of the present invention may be a two-piece golf ball as well as a multi-piece golf ball including an intermediate layer or a wound ball including a thread-wound layer.

According to the present invention, the golf ball is finished with paint and marking stamps for example in order to be improved in its appearance and accordingly put on the market.

EXAMPLES

As a rubber component in the rubber composition of the core, BR-11 (high cis polybutadiene) manufactured by JSR Corporation was used to which sulfur and an organic sulfur compound were added as shown in Table 2. Cover compositions are shown in Table 1. Vulcanization conditions for the rubber composition of the core are shown in Table 2. Golf balls of Examples 1, 2, 4 and 5 are two-piece golf balls each constituted of a core and an outer cover, and the golf ball of Example 3 is a three-piece golf ball constituted of a core, an inner cover and an outer cover.

For Comparative Examples, high cis polybutadiene as that of Examples was used as a rubber component of the rubber composition of the core to which one of sulfur and an organic sulfur compound was added as shown in Table 2. Vulcanization conditions for the rubber composition of the core are shown in Table 2. Golf balls of Comparative Examples 1, 2 and 3 are two-piece golf balls each constituted of a core and an outer cover, and the golf ball of Comparative Example 4 is a three-piece golf ball constituted of a core, an inner cover and an outer cover.

TABLE 1

| | cover composition | | |
|---|---|---|---|
| | A | B | C |
| Hi-milan 1605[X1] | 50 | 40 | 40 |
| Hi-milan 1706[X2] | 50 | 50 | 50 |
| Rabalon SR04[X3] | | 10 | 30 |
| titanium oxide | 2 | 2 | |
| barium sulfate | 2 | 2 | |
| hardness (JIS-C) | 93 | 89 | 81 |

[X1]Na-neutralized ethylene-methacrylic acid binary copolymer ionomer manufactured by Dupont-Mitsui Polychemicals Co., Ltd.
[X2]Zn-neutralized ethylene-methacrylic acid binary copolymer ionomer manufactured by Dupont-Mitsui Polychemicals Co., Ltd.
[X3]styrene-ethylene-butylene-styrene(SEBS) block copolymer-based thermoplastic elastomer manufactured by Mitsubishi Chemical Corporation

TABLE 2

| | | E1* | E2 | E3 | E4 | E5 | CE1** | CE2 | CE3 | CE4 |
|---|---|---|---|---|---|---|---|---|---|---|
| core composition | BR-11[X4] | 100 | 100 | 100 | 100 | 100 | 100 | 100 | 100 | 100 |
| | zinc acrylate | 31 | 35 | 30 | 32 | 31 | 26 | 28 | 32 | 20 |
| | zinc oxide | 10 | 10 | 10 | 10 | 10 | 10 | 10 | 10 | 10 |
| | barium sulfate[X5] | proper amount | Proper amount | proper amount | proper amount | proper amount | proper amount | proper amount | proper amount | amount |
| | diphenyl disulfide (organic sulfur compound) | 0.5 | 0.5 | 0.5 | 0.5 | 0.5 | 0.5 | 0.5 | — | 0.5 |
| | sulfur | 0.05 | 0.1 | 0.1 | 0.05 | 0.1 | — | — | 0.1 | — |
| | dicumyl peroxide | 1 | 1 | 1 | 1 | 1 | 2 | 1 | 1 | 1 |
| core characteristics | vulcanization conditions | 170° C./20 min | 170° C./20 min | 170° C./20 min | 160° C./20 min | 170° C./20 min | 175° C./20 min | 160° C./20 min | 160° C./20 min | 170° C./20 min |
| | diameter (mm) | 38.8 | 38.8 | 35.6 | 38.8 | 38.8 | 38.8 | 38.8 | 38.8 | 35.6 |
| | deformation amount (mm) | 3.8 | 3.6 | 4.5 | 3.5 | 4.2 | 4.2 | 4 | 3.8 | 6.2 |
| | center hardness (JIS-C hardness) | 51 | 48 | 46 | 55 | 47 | 53 | 58 | 55 | 50 |
| | surface hardness (JIS-C hardness) | 81 | 80 | 78 | 82 | 79 | 80 | 78 | 81 | 73 |
| | hardness difference | 30 | 32 | 32 | 27 | 32 | 27 | 20 | 26 | 23 |

TABLE 2-continued

| | | E1* | E2 | E3 | E4 | E5 | CE1** | CE2 | CE3 | CE4 |
|---|---|---|---|---|---|---|---|---|---|---|
| cover | inner cover composition | — | — | C | — | — | — | — | — | B |
| | inner cover hardness (JIS-C hardness) | — | — | 81 | — | — | — | — | — | 89 |
| | inner cover thickness (mm) | — | — | 1.6 | — | — | — | — | — | 1.6 |
| | outer cover composition | A | B | A | B | A | A | A | B | A |
| | outer cover hardness (JIS-C hardness) | 93 | 89 | 93 | 89 | 93 | 93 | 93 | 89 | 93 |
| | outer cover thickness (mm) | 2 | 2 | 2 | 2 | 2 | 2 | 2 | 2 | 2 |
| ball characteristics | restitution coefficient | 1.02 | 1.01 | 1.02 | 1.01 | 1.00 | 1.00 | 1.02 | 0.98 | 1.01 |
| | durability | 110 | 115 | 115 | 120 | 105 | 100 | 110 | 120 | 95 |
| | carry (m) | 178 | 179 | 180 | 179 | 178 | 176 | 179 | 176 | 178 |
| | shot feel (impact) | ◎ | ◎ | ◎ | ○ | ◎ | ○ | X | ○ | Δ |

[x4]high cis polybutadiene manufactured by JSR Corporation
[x5]The amount of barium sulfate was adjusted to allow a ball to weigh 45.4 g
*E: Example
**CE: Comparative Example The amount of deformation of the core was measured under a load from an initial load of 98 N to a final load of 1274 N.

The hardness of the core was measured at both of the surface and the center of the core. The surface hardness of the core was measured at the surface of the core while the center hardness of the core was measured on a cross section of the core that was produced by dividing the core into two hemispheres.

The hardness of the cover was measured as follows. The cover composition shown in Table 1 was used to produce thermal press sheets each having a thickness of approximately 2 mm, and the sheets were preserved at 23° C. for two weeks. Three such sheets were stacked on each other and the hardness thereof was measured by means of a spring type hardness tester (type C).

The JIS-C hardness was measured by means of a spring type hardness tester (type C) in accordance with JIS-K6301.

The coefficient of restitution was measured as follows. The golf ball was collided with a cylindrical object of aluminum weighing 200 g at a speed of 40 m/s, and respective speeds, after collision, of the cylindrical object and the golf ball were measured. The speeds before and after collision and weights of the object and the ball were used to calculate the coefficient of restitution. 12 golf balls were used for each Example and the average coefficient of restitution was calculated for each Example. The coefficient of restitution is represented by a relative value with respect to 1.00 of Comparative Example 1.

The durability of the golf ball was evaluated as follows. A W#1 driver having a metal head was mounted on a swing robot manufactured by True Temper Co., Ltd. and the golf ball was hit by the driver at a head speed of 45 m/sec. The golf ball was collided with a collision plate and accordingly the durability of the ball was evaluated. The evaluation was made based on how many times the ball was hit until the ball was broken. The durability is represented by a relative value with respect to 100 of Comparative Example 1. The greater value indicates that the golf ball has a higher durability.

The carry of the golf ball was measured as follows. A W#1 driver having a metal head was mounted on a swing robot manufactured by True Temper Co., Ltd. and the golf ball was hit by the driver at a head speed of 40 m/sec. The carry was measured as a total distance to the point where the ball stops. Here, the total distance includes the carry and run ending at the stop point. For each golf ball, five measurements were taken and the average thereof was used as a carry of the golf ball.

The shot (impact) feel was evaluated as follows. The golf balls were actually hit by 10 skillful professional golfers with W (wood) #1 clubs (drivers). The number of professional golfers who "feel good impact at shot" was used for evaluation. Referring to Table 2, the shot feel is indicated by ""◎" when 8 or more golfers "feel good," indicated by "○" when 6 or more golfers "feel good," indicated by "Δ" when 4 or more golfers "feel good" and indicated by "X" when 3 or less golfers "feel good."

Respective golf balls for Comparative Example 1 and Comparative Example 4 have low durability. The golf ball for Comparative Example 3 exhibits an unsatisfactory carry. The golf ball for Comparative Example 2 is inferior in shot feel. On the other hand, the golf balls for Examples 1 to 5 are excellent in durability and flight performance as well as shot feel.

The golf ball according to the present invention is constructed of at least two layers including a core and a cover. The core is formed of a rubber composition including 100 parts by weight of a rubber component, 0.01 to 0.5 parts by weight of sulfur and 0.05 to 5 parts by weight of an organic sulfur compound. The golf ball can accordingly be provided that has an improved shot feel without deterioration in durability and flight performance.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. A golf ball constituted of at least two layers comprising a core and a cover, said core being formed of a rubber composition including 100 parts by weight of a rubber component, 0.01 to 0.5 parts by weight of sulfur and 0.05 to 5 parts by weight of an organic sulfur compound, wherein the ratio of the amount of sulfur to the amount of organic sulfur compound is 0.01 to 2.0 wherein a difference determined by subtracting a center hardness of said core from a surface hardness of said core is at least 25 in terms of JIS-C hardness.

2. The golf ball according to claim 1, wherein said core has a center hardness less than 55 in terms of JIS-C hardness.

3. The golf ball according to claim 1, wherein sulfur is present in an amount of 0.01 to 0.3 parts by weight, and the organic sulfur compound is present in an amount of 0.1 to 2 parts by weight.

4. The golf ball according to claim 1, wherein sulfur is present in an amount of 0.01 to 0.1 parts by weight, and the organic sulfur compound is present in an amount of 0.2 to 1.5 parts by weight.

5. The golf ball according to claim 1, wherein the ratio of the amount of sulfur to the amount of organic sulfur compound is 0.05 to 1.0.

6. The golf ball according to claim 1, wherein the ratio of the amount of sulfur to the amount of organic sulfur compound is 0.01 to 0.5.

7. A golf ball constituted of at least two layers comprising a core and a cover, said core being formed of a rubber composition including 100 parts by weight of a rubber component, 0.01 to 0.5 parts by weight of sulfur and 0.05 to 5 parts by weight of an organic sulfur compound, wherein the ratio of the amount of sulfur to the amount of organic sulfur compound is 0.01 to 2.0 wherein a difference determined by subtracting a center hardness of said core from a surface hardness of said core is at least 25 in terms of JIS-C hardness wherein an amount of deformation of said core under a load from an initial load of 98 N to a final load of 1274 N is 2.5 to 6.0 mm.

8. The golf ball according to claim 7, wherein said core has a center hardness less than 55 in terms of JIS-C hardness.

9. The golf ball according to claim 8, wherein the ratio of the amount of sulfur to the amount of organic sulfur compound is 0.05 to 1.0.

10. The golf ball according to claim 8, wherein the ratio of the amount of sulfur to the amount of organic sulfur compound is 0.01 to 0.5.

* * * * *